US006657139B2

(12) United States Patent
Hasunuma

(10) Patent No.: US 6,657,139 B2
(45) Date of Patent: Dec. 2, 2003

(54) KEYBOARD

(75) Inventor: Seigo Hasunuma, Gunma (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 10/174,842

(22) Filed: Jun. 18, 2002

(65) Prior Publication Data

US 2002/0196164 A1 Dec. 26, 2002

(30) Foreign Application Priority Data

Jun. 21, 2001 (JP) ..... 2001-188230

(51) Int. Cl.[7] ..... H01H 13/70

(52) U.S. Cl. ..... 200/5 A; 200/512; 200/341; 400/491

(58) Field of Search ..... 200/5 A, 513, 200/517, 344, 341, 512; 400/491, 491.2, 495, 495.1, 496

(56) References Cited

U.S. PATENT DOCUMENTS 5,278,374 A * 1/1994 Takagi et al. ..... 200/513
6,068,416 A * 5/2000 Kumamoto et al. ..... 400/491
6,091,036 A * 7/2000 Hu ..... 200/344
6,183,150 B1 * 2/2001 Kao ..... 400/495
6,355,894 B2 * 3/2002 Miyakoshi ..... 200/5 A

* cited by examiner

*Primary Examiner*—Elvin Enad
*Assistant Examiner*—K. Lee
(74) *Attorney, Agent, or Firm*—David N. Lathrop, Esq.; Gallagher & Lathrop

(57) ABSTRACT

In a keyboard that comprises a membrane switch sheet having switch portions arranged all over it, a keyboard substrate and a keyboard frame having sandwiched therebetween the membrane switch sheet to provide therein rigidity, and actuators for ON/OFF control of the switch portions through openings made in the keyboard frame, the keyboard substrate and the keyboard frame are each formed by a thin aluminum sheet, the membrane switch sheet has plural through holes, and plural trapezoidal bumps or protrusions formed by stamping the keyboard substrate toward the keyboard frame are inserted through the plural through holes into surface-to-surface contact with the keyboard frame, the plural trapezoidal bumps being spot-welded in their flat top surfaces to the keyboard frame.

10 Claims, 9 Drawing Sheets

KEYBOARD

BACKGROUND OF THE INVENTION

The present invention relates to a keyboard for use as an input device of a computer and other similar devices and, more particularly, to a novel keyboard structure that achieves the low profile and the light weight.

FIG. 1 shows a conventional keyboard structure, which is identical with that proposed by the applicant of this application in Japanese Patent Application Laid-Open Gazette No. 288639/99 entitled "Keyboard Switch."

A description will be given first, with reference to FIGS. 1 and 2, of the prior art example. The illustrated keyboard is composed of a keyboard substrate 11, a membrane switch sheet 12, a keyboard frame 14 and an actuator 15. The substrate 11 and the frame 14 are each made of a metal sheet. The membrane switch sheet 12 is sandwiched between the substrate 11 and the frame 14 to provide rigidity in the membrane switch sheet 12 and hold it flat.

The membrane switch sheet 12 in this example is shown to be a laminated structure of formed a pattern sheet 12-1 and an insulating sheet 12-2. On the top of the pattern sheet 12-1 there are deposited contact patterns 12A and 12B forming a switch 12S and a wiring pattern (not shown) for detecting the conduction/nonconduction of electricity between the contact patterns 12A and 12B. In the insulating sheet 12-2 overlying the pattern sheet 12-1 there is made an opening 12C through which the contact patterns 12A and 12B and their surrounding areas are exposed. The pattern sheet 12-1 and the insulating sheet 12-2 are sandwiched between the substrate 11 and the frame 14 with the exposed surface of the insulating sheet 12-2 held upward.

In the frame 14 there is also formed an opening 14A at the position corresponding to the opening 12C made in the membrane switch sheet 12. Through these openings 14A and 12C a conduction part 18C projecting downward from the actuator 15 makes contact with the contact patterns 12A and 12B to establish electric connections between them.

The actuator 15 in this example comprises pairs of first and second links 6A and 6B forming a pantographic lifting or support frame as depicted in FIG. 2A; a keytop 17 (see FIG. 2B) mounted atop the pair of links 6A and 6B; and a tactile-response collapsible rubber dome 18 which, upon depression of the keytop 17, allows the conduction part 18C to move down into contact with the contact patterns 12A and 12B and, upon removal of the downward force applied to the keytop 17, restores the keytop 17 to the position of its top dead center.

The rubber dome 18 is composed of: a cylindrical portion 18A of a relatively large diameter that encompasses the contact patterns 12A and 12B; and a dome portion 18B with which the cylindrical portion 18A is capped. On the ceiling of the dome portion 18B there is protrusively provided the conduction part 18C having a flat lower end face. When a downward force is applied to the roof of the dome portion 18B through the keytop 17, the dome portion 18B becomes elastically deformed, bringing down the conduction part 18C. Incidentally, when the dome portion 18B is deformed to some extent, its reaction force sharply decreases due to its oilcan phenomenon, providing tactile feedback to the keytop 17 being depressed.

Reference numerals 14B and 14C respectively denote a pair of leg rotary shaft bearings and a pair of slide shaft bearings both formed by drawing the frame 14. The pair of leg rotary shaft bearings 14B rotatably receives leg rotary shafts 16A that extend outwardly from the lower end portions of the second links 6A at right angles thereto. The pair of leg slide shaft bearings 14C receives leg slide shafts 16A that similarly extend outwardly from the lower end portions of the second links 6A at right angles thereto, the leg slide shafts 16A being slidable parallel to the frame surface. Likewise, a pair of rotary bearings 17A formed on the underside of the keytop 17 rotatably receives first coupling rod 16C extending between top end portions of the pair of first links 6B. And, a pair of slide bearings 17B on the underside of the keytop 17 receives keytop support sliding shafts 16D protrusively provided on the inner side surfaces of top end portions of the pair of first links 6B, the sliding shafts 16D being slidable parallel to the underside of the keytop 17. The links 6A and 6B, the bearings 14B, 14C, 17A and 17B, and the keytop 17 constitute the pantographic support frame.

In this example, the substrate 11 and the frame 24 are fixedly joined together by: forming bumps 11A in the substrate 11 by stamping; inserting the bumps 11A through through holes 12D in the membrane switch sheet 12 into contact with the underside of the frame 14; and spot-welding the substrate 11 and the frame 14 at top surfaces or crests 19 of the bumps 11A. That is, the bumps 11A and the through holes 12D are provided at plural places in the substrate 11 and in the membrane switch sheet 12, respectively, so that the substrate 11 and the frame 14 are welded together at the plural places.

The above conventional keyboard uses an aluminum sheet for the substrate 11 and a stainless steel sheet for the frame 14. Before the stainless steel sheet came into use as the frame 14, a thick resin sheet had been used. The use of the thick resin sheet, however, inevitably increases the overall keyboard thickness. The use of the stainless steel sheet in place of the resin sheet permits reduction of the overall keyboard thickness. Because of its high specific gravity, however, the stainless steel sheet increases the overall weight of the keyboard.

Further reduction of the keyboard thickness and weight could be achieved by use of: a single-sheet keyboard structure in which the membrane switch sheet 12 is deposited all over the substrate 11 as of aluminum low in specific gravity and the actuator 15 is mounted directly on the top of the membrane switch sheet 12; or a two-sheet keyboard structure in which in which the membrane switch sheet 12 is sandwiched between the substrate 11 and the frame 14 both of which are thin aluminum sheets (for example, 0.2 to 0.3 mm thick).

The present inventor studied which of the one- and two-sheet keyboard structures would be mechanically stronger. The following is cross-sectional secondary moments $I_1$ and $I_2$ of aluminum sheets with a length b and thicknesses $t_1$=0.6 mm and $t_2$=0.5 mm, respectively, as depicted in FIGS. 3A and 3B and the cross-sectional secondary moment $I_3$ of a laminated member of two aluminum sheets with the length b and thicknesses $t_3$=0.3 mm and $t_4$=0.2 mm, respectively, as depicted in FIG. 3C.

$$I_1=(b/12)(0.6^3)=0.018b$$

$$I_2=(b/12)(0.5^3)=0.010b$$

$$I_3=(b/12)(0.8^3-0.3^3)=0.04b$$

The cross-sectional secondary moment $I_3$ of the laminated structure is about twice larger than the cross-sectional secondary moment $I_1$ of the single-sheet structure of the thickness $t_1$=0.6 mm and approximately four times larger than in the case of the single-sheet structure of the thickness $t_2$=0.5 mm.

In the case of the two-sheet structure, although each sheet is as thin as around 0.2 to 0.3 mm, the cross-sectional secondary moment is $I_3$=0.04b about twice larger than in the case of the single-sheet structure with $t_1$=0.6 mm and about four times larger than in the case of the single-sheet structure with $t_2$=0.5 mm. This suggests that the two-sheet structure is greater in rigidity than the single-sheet structures. Accordingly, the two-sheet keyboard structure will achieve the low profile and light weight.

SUMMARY OF THE INVENTION

It is therefore an object of the present invention to provide a two-sheet-structured keyboard of great rigidity.

The keyboard according to the present invention comprises:

a membrane switch sheet having switch portions arranged thereon in matrix form and through holes made therein in correspondence to the arrangement of keys, each of said switch portions having a pair of contact patterns;

a keyboard frame formed by a thin sheet of aluminum that has openings made therein opposite said switch portions, said keyboard frame being laminated on the top of said membrane switch sheet to provide therein rigidity;

a keyboard substrate formed by a thin sheet of aluminum that has a plurality of trapezoidal bumps formed by stamping for engagement with said through holes, said keyboard substrate being laminated on the underside of said membrane switch sheet with said membrane switch sheet sandwiched therebetween, and said plurality of trapezoidal bumps being welded to said keyboard frame; and an actuator mounted above each of said opening portions of said keyboard frame to make and break each of said switch portions in response to the depression of a keytop.

DETAILED DESCRIPTION OF THE PREFERRED EMBODIMENTS

Figure 4:
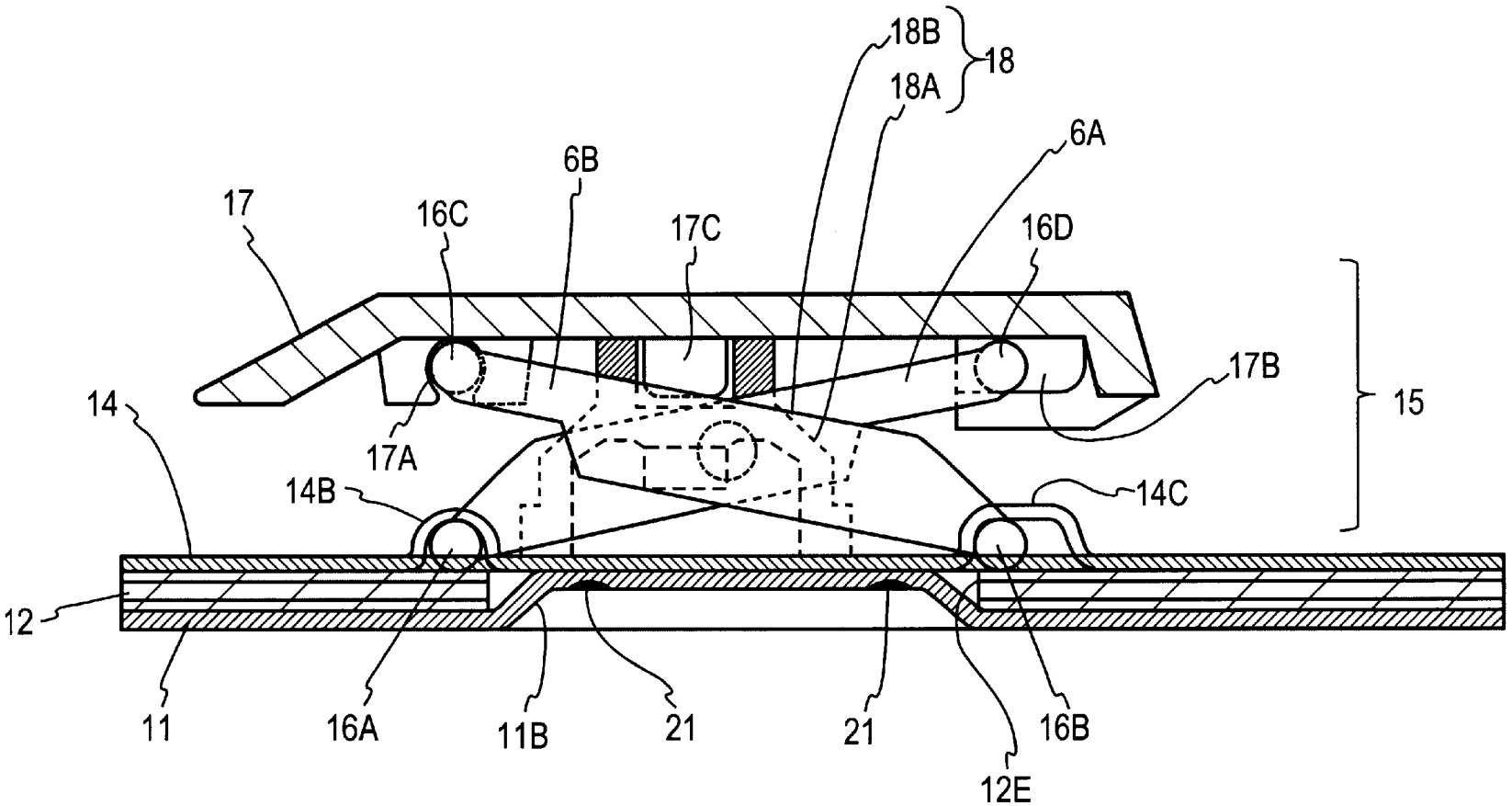
FIG. 4 is a sectional view taken on the line 4—4 in FIG. 5, for explaining an embodiment of the present invention.

A description will be given, with reference to FIGS. 4 to 7, of an embodiment of the keyboard according to the present invention. FIG. 4 is a sectional view taken on the line 4—4 in FIG. 5. The keyboard according to the present invention is provided with: the keyboard substrate 11 and the keyboard frame 14 between which the membrane switch sheet 12 for ON/OFF switching operation is sandwiched to provide rigidity in the membrane switch sheet 12 as described previously in respect of the FIG. 1 prior art example; and the actuators 15 each of which applies pressure through one of the openings 14A (see FIG. 5) to the membrane switch sheet 12 to cause it to perform an ON/OFF switching operation.

Figure 5:
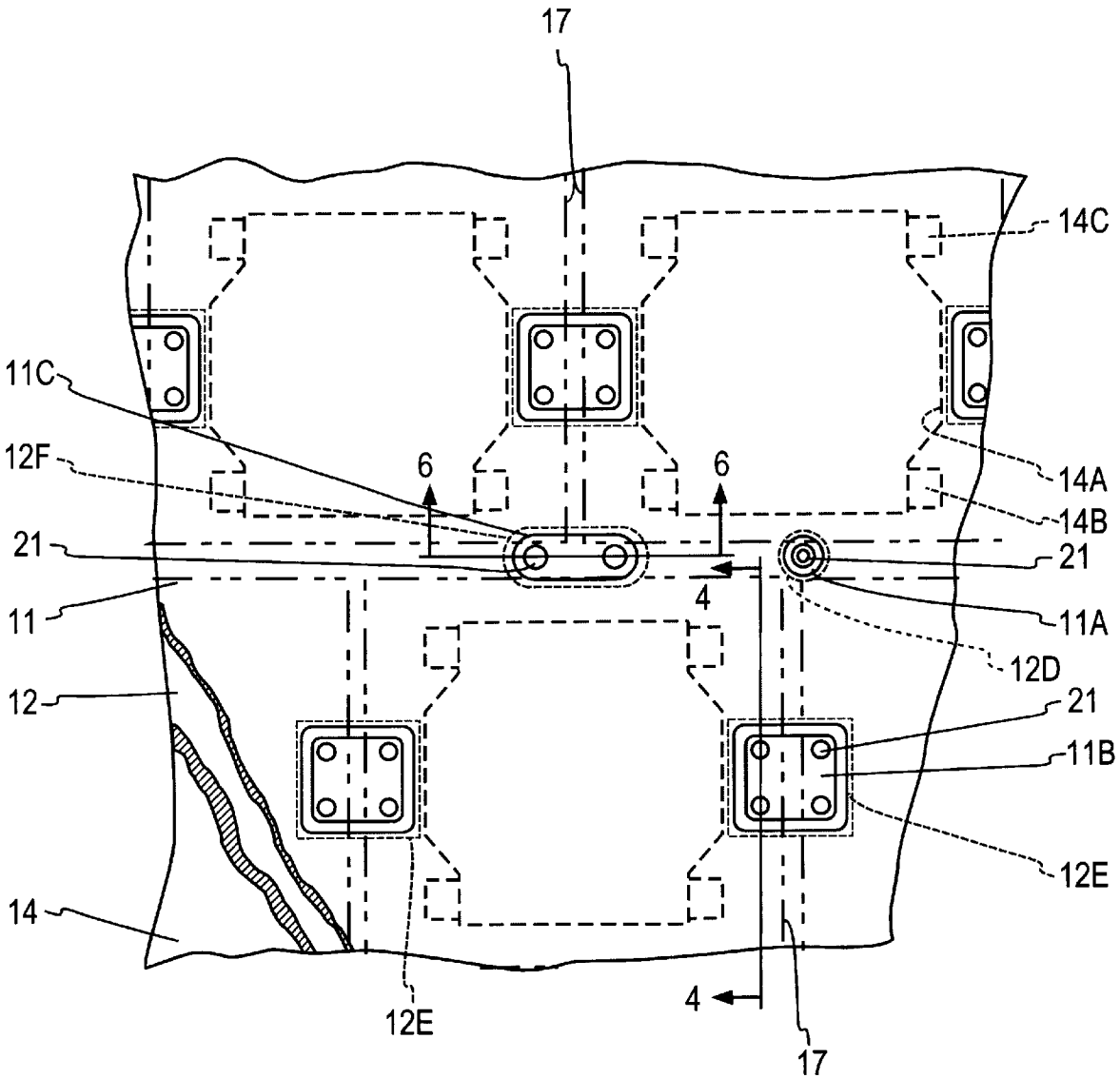
FIG. 5 is an enlarged bottom view of the FIG. 4 embodiment.
Figure 6:
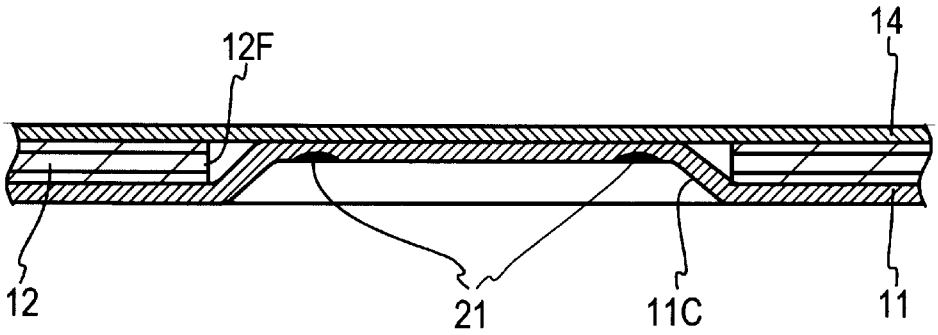
FIG. 6 is an enlarged sectional view taken on the line 6—6 in FIG. 5.

In this embodiment, the substrate 11 and the frame 14 are both formed by aluminum thin sheets with a view to reducing the total weight of the keyboard structure. At the same time, to compensate for the decreased strength of the keyboard caused by the use of the thin aluminum sheets, through holes 12E and 12F are made in the membrane switch sheet 12 adjacent the substantially rectangular openings 14A made in the frame 14, and trapezoidal bumps or protrusions 11B and 11C are formed by stamping the substrate 11 in opposing relation to the through holes 12E and 12F. The trapezoidal bumps 11B are square in plan configuration, whereas the bumps 11C are elliptic in plan configuration. The heights of the trapezoidal bumps 11B and 11C are nearly equal to the thickness of the membrane switch sheet 12. FIG. 5 is a view of the keyboard from its bottom side (from the substrate 11 side). FIG. 6 is a sectional view taken along the line 6—6 in FIG. 5. Incidentally, the bump 11A fitted in the through hole 12D in FIG. 5 has the same configuration as that of the bump 11A fitted in the through hole 12D described previously with reference to FIG. 1.

In FIG. 5, the direction of the line 6—6 will hereinafter be referred to as a row direction and the direction of the line 4—4 as an inter-row direction. The arrangement of the keytops 17 is indicated by the two-dot chain line. The openings 14A are formed in plural rows in a staggered configuration in correspondence to the arrangement of the actuators 15. The through holes 12E are made in the membrane switch sheet 12 between adjacent openings 14A in the same row, and the through holes 12F are made in the membrane switch sheet 12 between adjacent rows of openings 14A. Accordingly, the square trapezoidal bumps 11B are fitted in the through holes 12E formed between the openings 14A arranged in the row direction, and the elliptic trapezoidal bumps 11C and the circular trapezoidal bumps 11A are formed between the rows of openings 14A.

Figure 7:
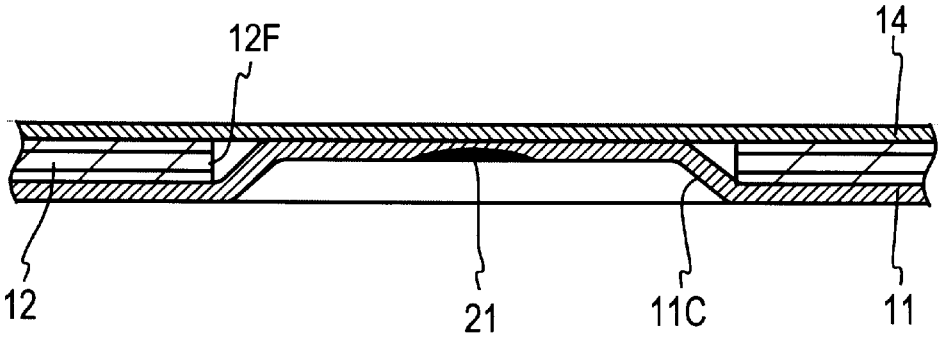
FIG. 7 is an enlarged sectional view illustrating a modification of the cross-section along the line 4—4 in FIG. 5.

The trapezoidal bumps 11B and 1C are called trapezoidal since their top surfaces are formed flat. These trapezoidal bumps 11B and 11C are fitted in the through holes 12E and 12F made in the membrane switch sheet 12 with their flat top surfaces in contact with the back of the frame 14, and the substrate 11 and the frame 14 are joined together by spot-welding them at one or more points of their contact portions. Reference numeral 21 denotes welded portions (by spot-welding that uses laser light, for instance). In the FIG. 5 embodiment the square trapezoidal bumps 11B are each spot-welded at four corners to the frame 14, whereas the elliptic trapezoidal bumps 11C are each spot-welded at two points to the frame 14. FIG. 7 shows the case where the bumps 11C are each welded at one point. In this instance, it is desirable to provide sufficient strength at the welded joint by welding over a relatively wide area. Such a single-spot-welding scheme permits substantial reduction in the number of welded joints, hence decreasing the number of manufacturing steps involved.

With the structure in which the substrate 11 and the frame 14 are welded to each other at places between adjacent openings 14A in each row and between the rows of openings 14A, it is possible to firmly join the substrate 11 and the frame 14, providing increased strength in the keyboard. In particular, the formation of the openings 14A in the frame 14 decreases its strength around the openings 14A, but the decrease in the strength of the frame 14 can be suppressed by welding it to the substrate 11 at the points adjoining the openings 14A. This constitutes a major factor for succeeding in the production of a great-rigidity keyboard.

Figure 1:
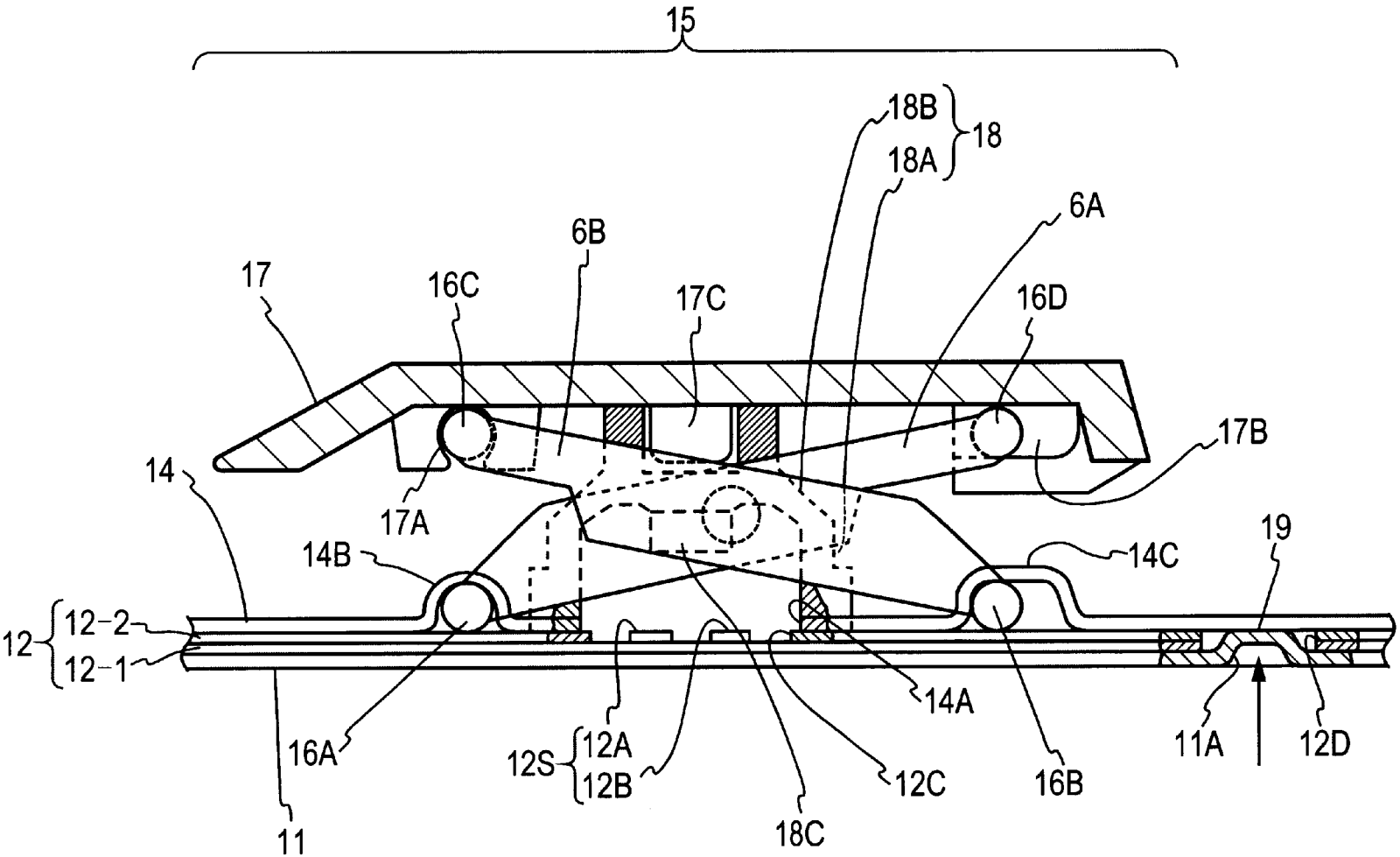
FIG. 1 PRIOR ART
FIG. 1 is a diagram, partly in section, depicting a prior art example.
Figure 2B:
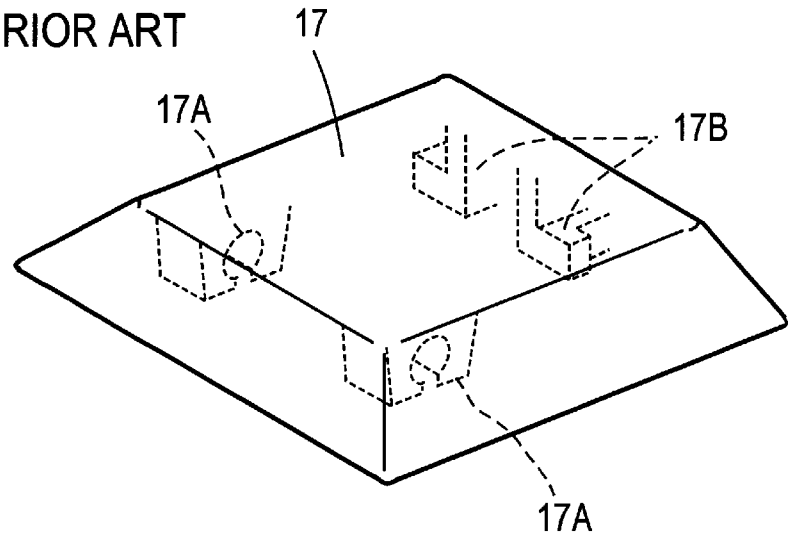
FIG. 2B PRIOR ART
FIG. 2B is a perspective view of a keytop used in the FIG. 1 example.
Figure 2A:
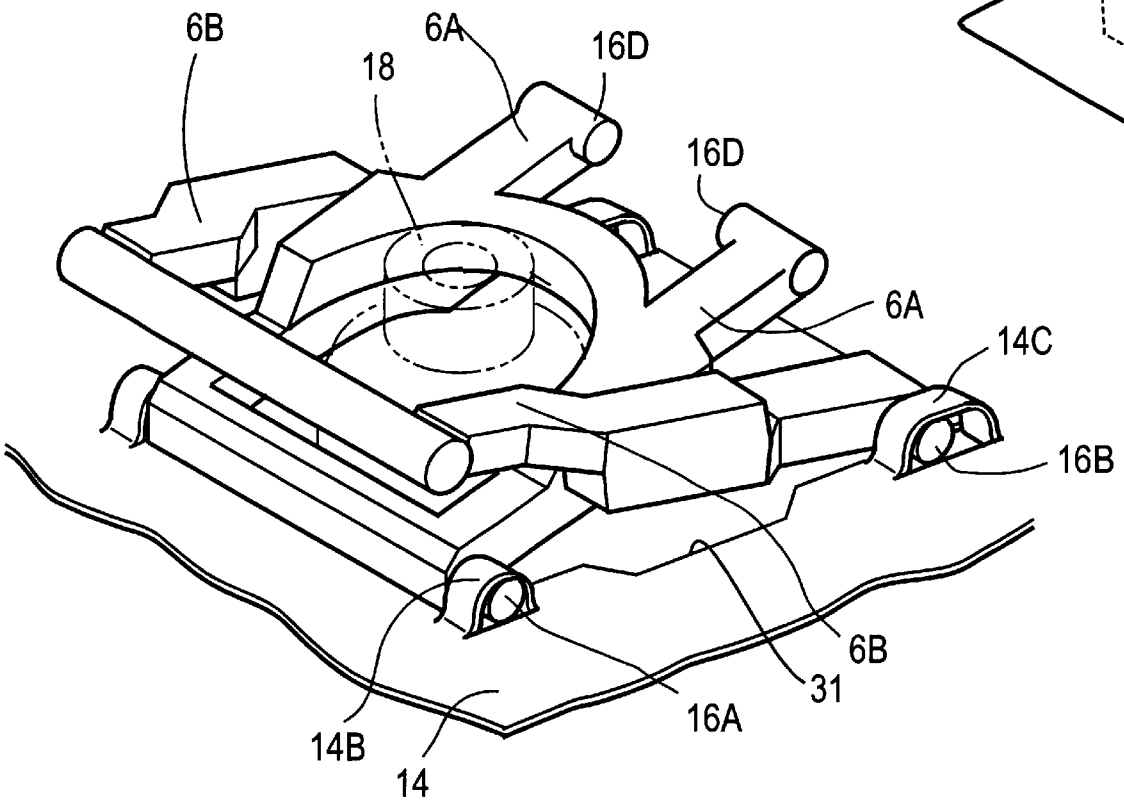
FIG. 2A PRIOR ART
FIG. 2A is a perspective view of a pantographic support frame used in the FIG. 2 example.
Figure 3A:
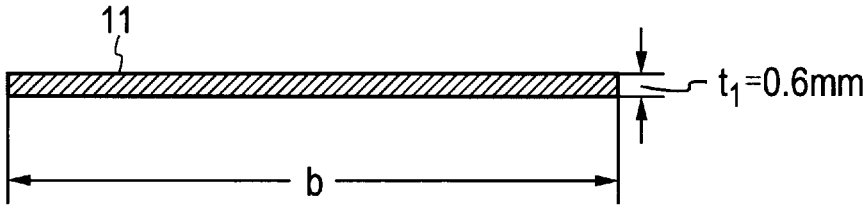
FIG. 3A is sectional view of a reinforcement member using one plate of a certain thickness.
Figure 3B:
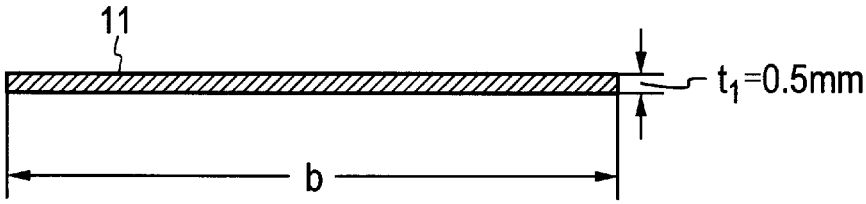
FIG. 3B is sectional view of a reinforcement member using one plate of another thickness.
Figure 3C:
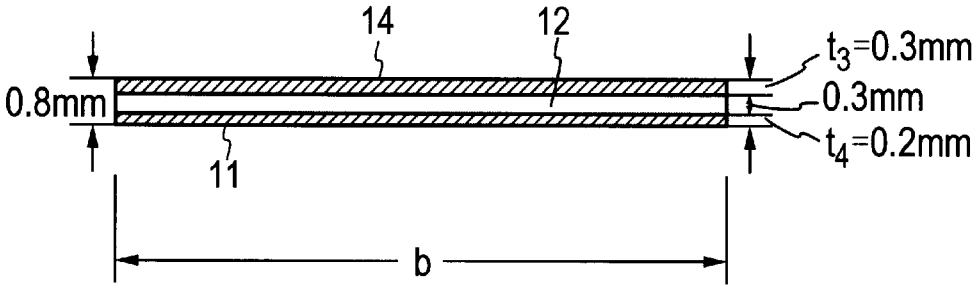
FIG. 3C is sectional view of a reinforcement member using two plates of different thicknesses.

While the FIG. 4 embodiment has been described to use the pantograph structure for the actuator 15, the present invention is not limited specifically to such a structure. As will be easily seen from the above, the present invention is applicable not only with the membrane switch sheet 12 of the two-sheet configuration in which the contact patterns 12A and 12B are exposed as depicted in FIG. 1 but also with a membrane switch sheet of a three-sheet configuration in which three insulating sheets are laminated so that the contact patterns are not exposed.

Figure 8:
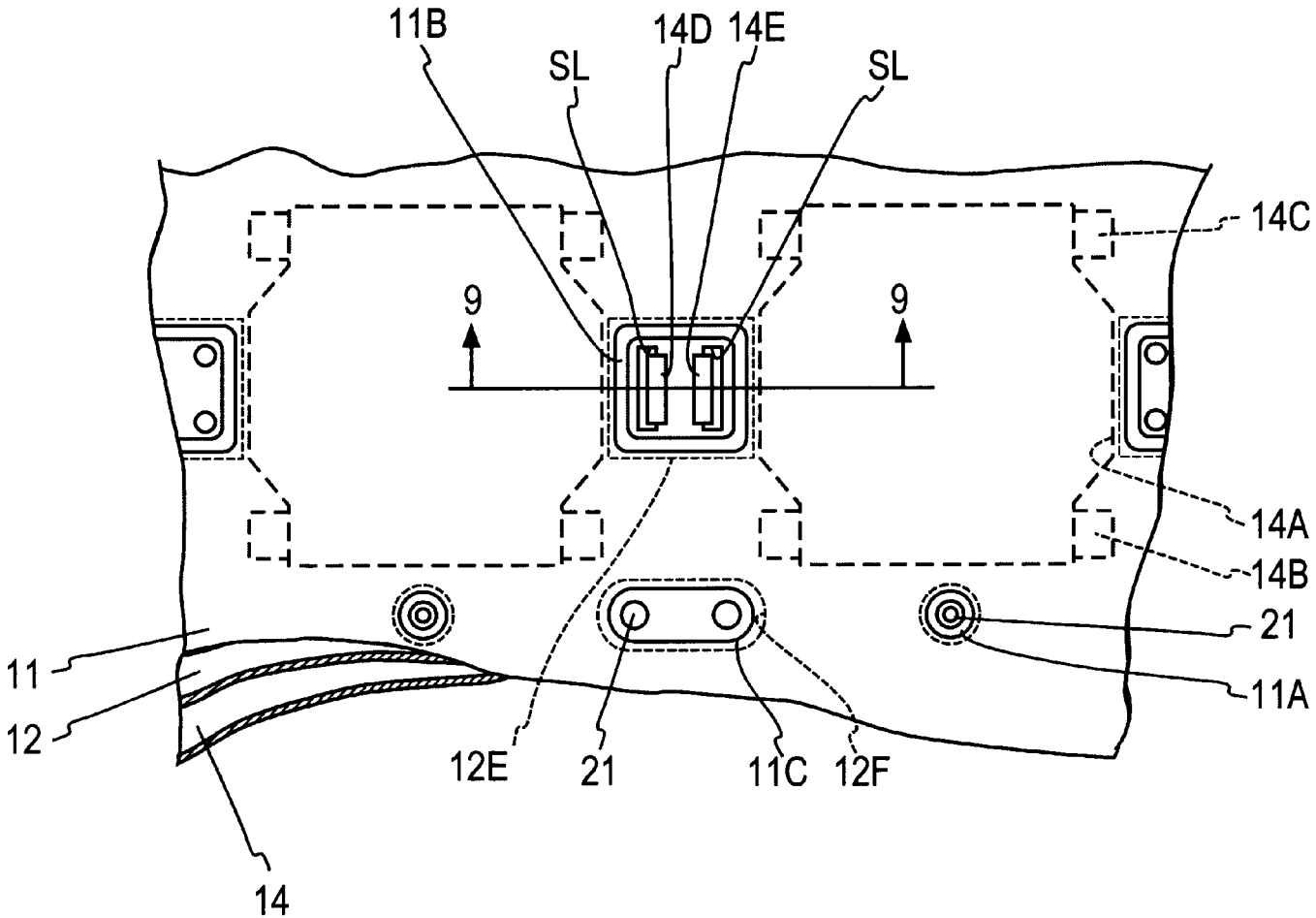
FIG. 8 is an enlarged bottom view of the keyboard structure according to the present invention, for explaining other structural features.
Figure 9:
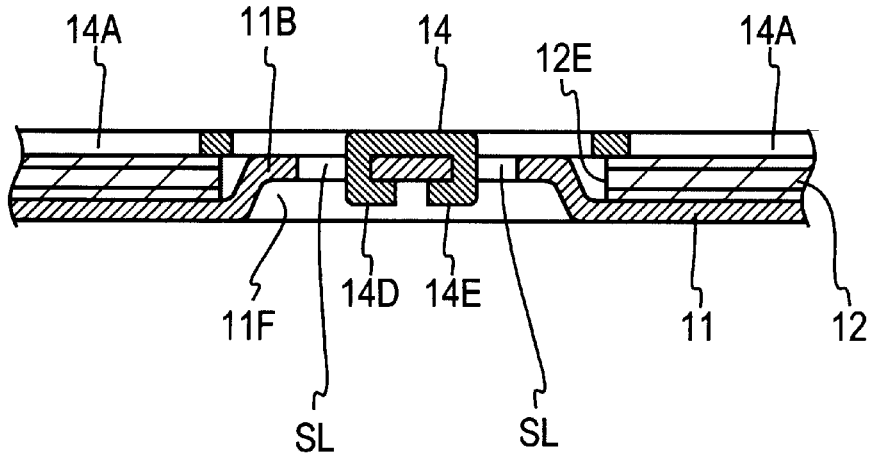
FIG. 9 is an enlarged sectional view taken on the line 9—9 in FIG. 8.

Turning next to FIGS. 8 and 9, another embodiment of the present invention will be described below. FIG. 9 is an enlarged sectional view taken along the line 9—9 in FIG. 8. This embodiment uses aluminum thin sheets for the keyboard substrate 11 and the keyboard frame 14 to achieve weight reduction of the keyboard. Further, some of the trapezoidal bumps or protrusions 11B formed by stamping the substrate 11 are not welded to the frame 14 in the through holes 12E made in the membrane switch sheet 12, but instead a pair of parallel rectangular lugs 14D and 14E are downturned from the frame 14 in the area just above each through hole 12E, and inserted through a pair of parallel slits SL made in the top of the trapezoidal bump 11B, then the lower ends of the downturned lugs 14D and 14E projecting beyond the underside of the bump 11B are bent parallel thereto so that the lugs 14E and 14D are swaged to the bump 11B. This is intended to provide increased rigidity in the substrate 11 and the frame 14 joined together.

It is desirable that the number of such swaged structures as shown in FIGS. 8 and 9 be in the range of 10 to 20% of the trapezoidal bumps 11B, and the swaged structures are uniformly spread all over the keyboard. The swaged structures provide increased rigidity in the keyboard formed by the substrate 11, the membrane switch sheet 12 and the frame 14. Since the swaged structures afford rigidity particularly against bending about the direction perpendicular to the line 9—9 in FIG. 8, the rigidity of the keyboard can be further increased by uniformly arranging the pairs of lugs 14D and 14E so that the lugs 14A and 14E are bent at right angles to those in adjacent trapezoidal bumps 11B. Furthermore, by selecting the thickness of the frame 14 to be equal to or smaller than the depth of a recess 11F defined on the back side of the bump 11B, the lugs 14D and 14E do not project beyond the underside of the plate 11 as shown in FIG. 9—this enables the realization of a low-profile keyboard.

Figure 10:
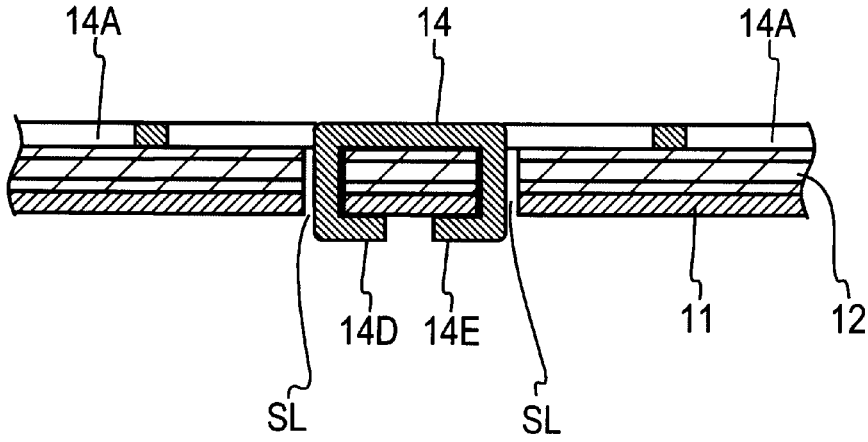
FIG. 10 is a sectional view showing a modification of the cross-section depicted in FIG. 9.

In the embodiments of FIGS. 8 and 9, the slits SL are made in each trapezoidal bump 11B, and the lugs 14D and 14F downturned from the frame 14 are swaged thereto in the opening 14E made therein. It is also possible, however, to employ such a structure as depicted in FIG. 10, in which the trapezoidal bumps 11B in the substrate 11 and the openings 12F in the membrane switch sheet 12 are not formed between some of adjacent openings 14A and the openings 12F but instead the lugs 14D and 14E are swaged to the substrate 11 after being inserted through slits SL made in the substrate 11 and the membrane switch sheet 12. In this case, however, the bent portions of the lugs 14A and 14E project out beyond the back of the substrate 11.

Figure 11:
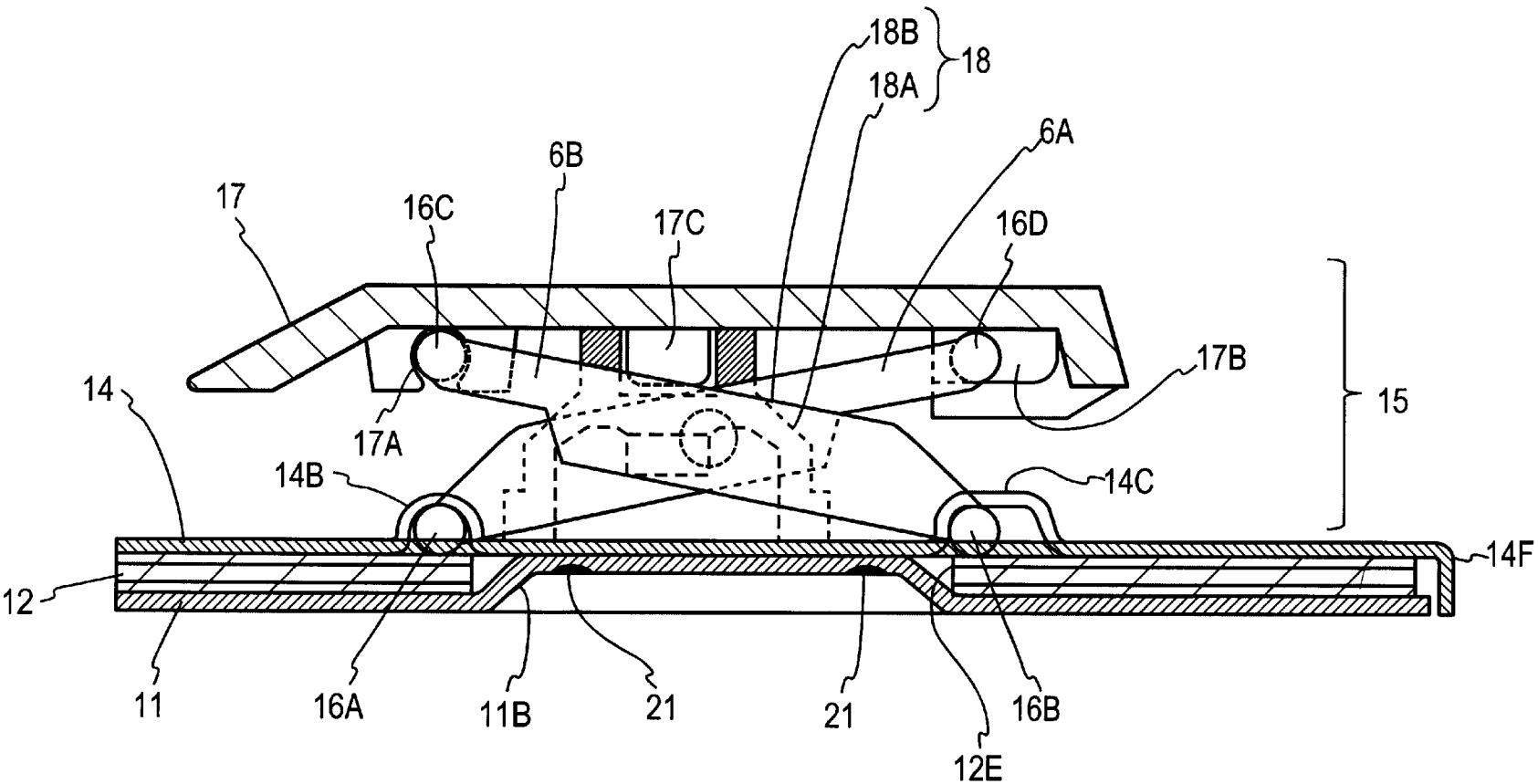
FIG. 11 is a diagram, partly in section, illustrating another embodiment of the present invention.

FIG. 11 illustrates another embodiment of the keyboard according to the present invention. In this embodiment the keyboard substrate 11 and the keyboard frame 14 are both formed by aluminum thin sheets so as to reduce the thickness and weight of the keyboard, and with a view to providing increased rigidity in the keyboard, the marginal portion of the frame 14 is downturned at right angles to form a bent portion 14F. In this instance, by extending the bent portion 14F as long as possible along the entire thickness of the substrate 11, the strength of the bent portion 14F is maximized to provide greater rigidity of the frame 14. With the bent portion 14F all around the frame 14, it is possible to increase the rigidity of the frame 14 and hence provide a keyboard of increased rigidity accordingly.

In each of the embodiments described above, the use of aluminum thin sheets for the key board substrate 11 and the keyboard frame 14 permits reduction of the thickness of the keyboard with the substrate 11, the membrane switch sheet 12 and the frame 14 laminated. Incidentally, by using a 0.2 mm thick aluminum sheet for the substrate 11, a 0.3 mm thick aluminum sheet for the frame 14 and a 0.3 mm thick membrane sheet, the total thickness of the keyboard can be made as small as 0.8 mm.

In addition, the use of the thin aluminum sheet for the frame 14 permits reduction of the keyboard weight by approximately 20 to 30% as compared with a keyboard using a stainless steel plate.

Besides, even if the frame 14 is formed by an aluminum thin sheet with a view to weight reduction, the rigidity of the keyboard can be increased as described above by an arbitrary combination of:

(a) the structure in which the top surfaces of the trapezoidal bumps or protrusions 11B and 11C are spot-welded at one or more points to the back of the frame 14;

(b) the structure in which the frame 14 and the substrate 11 are joined together by swaging the lugs 14D and 14E to the substrate 11; and (c) the structure in which the marginal portion of the frame 14 is downturned to form the bent portion 14.

Accordingly, the present invention provides lightweight, low-profile and highly rigid keyboard, and hence the invention is of great utility when employed in practice.

Moreover, by performing the spot-welding step after joining the frame 14 and the substrate 11 by swaging the lugs 14D and 14E to the substrate 11, the positioning of the membrane switch sheet 12 and the substrate 11 relative to each other is completed with the swaging step—this allows ease in the subsequent spot-welding step.

EFFECT OF THE INVENTION

As described above, the keyboard according to the present invention using aluminum for the keyboard frame 14 can be made lightweight as compared with a keyboard using a frame made of stainless steel. In particular, by making through holes in the membrane switch sheet at plural positions, then inserting through the through holes trapezoidal bumps formed by stamping of the substrate, and then welding the bumps to the frame, the substrate and the frame can be firmly joined together to provide great rigidity. This enables the realization of a lightweight, great-rigidity keyboard.

With the welded point between adjacent openings in the row direction or between rows of the openings made in the frame, it is possible to reinforce strength-decreased portions of the frame between the openings. This provides increased strength of the frame and hence further increases the strength of the laminated substrate and frame structure.

Furthermore, the top surfaces of the trapezoidal bumps or protrusions formed by stamping the frame are disposed in surface-to-surface contact relationship with the frame and the surface-contact portion is spot-welded at one or more points, by which the substrate and the frame can be held parallel to each other. The spot-welding at plural points enables the substrate and the frame to be firmly jointed together. The spot-welding does not deform the surrounding portion, in particular, the frame that is ultimately used as the keyboard surface; therefore, a high-quality keyboard can be obtained.

With the structure in which the lugs extended from the frame are projected out onto the underside of the trapezoidal bump through the through holes in the membrane switch sheet and the substrate and the projected end portions of the lugs are bent along the underside of the substrate to swage thereto the frame, the substrate and the frame can be joined together more firmly. In addition, bending the lugs provides increased rigidity in the direction perpendicular to that in which the lugs are bent. This ensures fabrication of a lightweight but great-rigidity keyboard.

Moreover, since the lugs bent on the back of the substrate are received in the recess defined by the underside of the trapezoidal bump, the lugs do not project out beyond the back of the keyboard substrate. Accordingly, the lug swaging structure does not constitute an obstacle to the realization of a low-profile keyboard.

Besides, the bent portion downturned from the keyboard frame all around it provides increased rigidity in the entire frame structure, thereby preventing the keyboard from bending or deformation.

What is claimed is:

1. A keyboard comprising:

a membrane switch sheet having switch portions arranged thereon in matrix form and through holes made therein in correspondence to the arrangement of keys, each of said switch portions having a pair of contact patterns;

a keyboard frame formed by a thin sheet of aluminum that has openings made therein opposite said switch portions, said keyboard frame being laminated on the top of said membrane switch sheet to provide therein rigidity;

a keyboard substrate formed by a thin sheet of aluminum that has a plurality of trapezoidal bumps formed by stamping for engagement with said through holes, said keyboard substrate being laminated on the underside of said membrane switch sheet with said membrane switch sheet sandwiched between said keyboard substrate and said keyboard frame, and said plurality of trapezoidal bumps being welded to said keyboard frame; and an actuator mounted above each of said opening portions of said keyboard frame to make and break each of said switch portions in response to the depression of a keytop.

2. The keyboard of claim 1, wherein said openings are made in plural rows all over said keyboard frame and said through holes are each made in said membrane switch sheet in opposing relation to the area between adjacent ones of said openings in each row direction.

3. The keyboard of claim 1, wherein said openings are made in plural rows all over said keyboard frame and said through holes are each made in said membrane switch sheet in opposing relation to the area between adjacent rows of said openings.

4. The keyboard of any one of claims 1 to 3, wherein two or more of said trapezoidal bumps have flat top surfaces for surface-to-surface contact with the underside of said keyboard frame, said two or more of trapezoidal bumps having their flat top surfaces spot-welded at one or more points to said keyboard frame.

5. The keyboard of any one of claims 1 to 3, wherein the other remaining trapezoidal bumps each have made therein at least one slit, and lugs extended from said keyboard frame toward said keyboard substrate are each inserted through one of said at least one slit onto the back of one of said trapezoidal bumps, the projecting end portions of said each lug being bent to join said keyboard frame and said keyboard substrate together.

6. The keyboard of claim 5, wherein the thickness of said each lug is accommodated by a recess defined by the underside of one of said trapezoidal bumps.

7. The keyboard of claim 5, wherein said at least one slit in each of said trapezoidal bumps is made at right angles to said at least one slit in each of adjacent ones of said trapezoidal bumps.

8. The keyboard of claim 5, wherein said trapezoidal bumps have two parallel slits for the insertion therethrough of two lugs extended from said keyboard frame, said the projected end portions of said two lugs being swaged to said keyboard substrate.

9. The keyboard of any one of claims 1 to 3, wherein said membrane switch sheet and said keyboard substrate each have plural slits extending therethrough and plural lugs extended from said keyboard frame toward said keyboard substrate are inserted through said plural slits onto the back of said keyboard substrate, the projecting end portions of said plural lugs being bent parallel to the back of said keyboard substrate to firmly join said keyboard frame and said keyboard substrate together.

10. The keyboard of any one of claims 1 to 3, wherein said keyboard frame has its marginal portion bent all around it toward said keyboard substrate.

* * * * *